US006706241B1

(12) United States Patent
Baumann et al.

(10) Patent No.: US 6,706,241 B1
(45) Date of Patent: Mar. 16, 2004

(54) NICKEL-BASE SUPERALLOY

(75) Inventors: Robert Baumann, Klinganu (CH); David Duhl, Jupiter, FL (US); Andreas Kuenzler, Baden (CH); Mohamed Nazmy, Fislisbach (CH)

(73) Assignee: Alstom Technology Ltd, Baden (CH)

( * ) Notice: Subject to any disclaimer, the term of this patent is extended or adjusted under 35 U.S.C. 154(b) by 0 days.

(21) Appl. No.: 10/291,392

(22) Filed: Nov. 12, 2002

(51) Int. Cl.[7] ..... C22C 19/05
(52) U.S. Cl. ..... 420/448; 148/428
(58) Field of Search ..... 148/428; 420/448

(56) References Cited

U.S. PATENT DOCUMENTS 4,643,782 A 2/1987 Harris et al.
4,683,119 A * 7/1987 Selman et al. ..... 420/444
4,719,080 A * 1/1988 Duhl et al. ..... 420/443
5,270,123 A 12/1993 Walston et al.
6,468,367 B1 * 10/2002 Mukira et al. ..... 148/428
2002/0157738 A1 * 10/2002 Burgel et al. ..... 148/562

FOREIGN PATENT DOCUMENTS

EP 0208645 B1 8/1992
EP 0914483 B1 8/2000

* cited by examiner

*Primary Examiner*—John Sheehan
(74) *Attorney, Agent, or Firm*—Burns, Doane, Swecker & Mathis, L.L.P.

(57) ABSTRACT

The invention relates to a nickel-base superalloy for producing single-crystal components. The alloy according to the invention is characterized by the following chemical composition (details in % by weight): 7–13 Cr, 4–10 Co, 0.5–2 Mo, 2–8 W, 4–6 Ta, 3–6 Al, 1–4 Ti, 0.1–6 Ru, 0.01–0.5 Hf, 0.001–0.15 Si, 0–700 ppm C, 0–300 ppm B, remainder Ni and production-related impurities.

4 Claims, 5 Drawing Sheets

NICKEL-BASE SUPERALLOY

FIELD OF THE INVENTION

The invention deals with the field of materials science. It relates to a nickel-base superalloy, in particular for the production of single-crystal components, such as blades or vanes for gas turbines.

BACKGROUND OF THE INVENTION

Nickel-base superalloys of this type are known. Single-crystal components made from these alloys have a very good strength at high temperatures. This allows, for example, the intake temperature of gas turbines to be increased, with the result that the efficiency of the gas turbine rises.

Nickel-base superalloys for single-crystal components, as are known from U.S. Pat. No. 4,643,782, EP 0 208 645 and U.S. Pat No. 5,270,123, for this purpose contain alloying elements which strengthen the solid solution, for example Re, W, Mo, Co, Cr, and elements which form γ' phases, for example Al, Ta and Ti. The level of high-melting alloying elements (W, Mo, Re) in the basic matrix (austenitic γ phase) increases continuously as the temperature of load on the alloy increases. For example, standard nickel-base superalloys for single crystals contain 6–8% of W, up to 6% of Re and up to 2% of Mo (details in % by weight). The alloys disclosed in the abovementioned documents have a high creep strength, good LCF (low cycle fatigue) and HCF (high cycle fatigue) properties and a high resistance to oxidation.

These known alloys were developed for aircraft turbines and were therefore optimized for short-term and medium-term use, i.e. the load time was designed for up to 20,000 hours. By contrast, industrial gas turbine components have to be designed for a load time of up to 75,000 hours.

By way of example, after a load time of 300 hours, the alloy CMSX-4 which is known from U.S. Pat. No. 4,643,782, when it was tested for use in a gas turbine at a temperature of over 1000° C., underwent considerable coarsening of the γ' phase, which disadvantageously leads to an increase in the creep rate of the alloy.

The alloys which are known, for example, from U.S. Pat. No. 5,270,123 also have similar drawbacks. The alloying elements selected in that document cause, in the abovementioned alloys, a positive or negative lattice offset between the γ phase which forms the matrix and the γ' phase, i.e. the secondary intermetallic phase $Ni_3Al$, in which Ta, Ti, Hf may partially replace Al and Co and Cr may partially replace Ni. This lattice strain prevents dislocations during sliding or cutting of the γ' grains. Although the lattice strain increases the short-term strength, under longer load the microstructure becomes coarser, followed by degradation of the γ' structure, with an associated long-term mechanical weakening of the alloy.

This drawback is eliminated by the alloy which is known from EP 0 914 483 B 1. This nickel-base superalloy essentially consists of (measured in % by weight) 6.0–6.8% Cr, 8.0–10.0% Co, 0.5–0.7% Mo, 6.2–6.6% W, 2.7–3.2% Re, 5.4–5.8% Al, 0.5–0.9Ta, 0.15–0.3% Hf, 0.02–0.04% C, 40–100 ppm B, 0–400 ppm Y, remainder Ni with impurities, where the ratio of (Ta+1.5 Hf+0.5 Mo−0.5 Ti)/(W+1.2 Re) is $\geqq 0.7$. On account of the abovementioned ratio of the alloying elements, at operating temperature these alloys do not have a lattice offset between the γ phase and the γ' phase, with the result that a high long-term stability under moderate load is achieved. In addition, this rhenium-alloyed nickel-base superalloy has excellent casting properties and a good phase stability in combination with optimum mechanical properties. Moreover, it is distinguished by a high fatigue strength and creep stability even under long-term load.

Furthermore, it has been determined that in the presence of a mechanical load and a long-term high-temperature stress, there is targeted coarsening of the γ' particles, the phenomenon known as rafting, and at high γ' contents, (i.e. at a γ' content of at least 50% by volume) the microstructure is inverted, i.e. γ' becomes the continuous phase in which what was previously the γ matrix is embedded. Since the intermetallic γ' phase tends toward environmental embrittlement, under certain loading conditions this leads to a massive drop in the mechanical properties, in particular the yield strength, at room temperature (degradation of the properties). Environmental embrittlement occurs in particular in the presence of moisture and long holding times under tensile load.

SUMMARY OF THE INVENTION

It is an object of the invention to avoid the abovementioned drawbacks. The invention is based on the object of developing a nickel-base superalloy which, on the one hand, has a solid, strong γ phase as the matrix and, on the other hand, has only a low level, i.e. less than 50%, of γ' phase, and is therefore very resistant to oxidation and has a good creep behavior.

According to the invention, this object is achieved by the fact that the nickel-base superalloy according to the invention is characterized by the following chemical composition (details in % by weight):

7–13 Cr
4–10 Co
0.5–2 Mo
2–8 W
4–6 Ta
3–6 Al
1–4 Ti
0.1–6 Ru
0.01–0.5 Hf
0.001–0.15 Si
0–700 ppm C
0–300 ppm B remainder nickel and production-related impurities.

The advantages of the invention consist in the fact that the alloy has a good degradation behavior. The γ phase (matrix) is strengthened by the addition of ruthenium to the alloy, despite the absence of rhenium, which according to the known prior art is considered to be a particularly good element for strengthening the solid solution and therefore greatly improves the properties of the γ matrix. The alloy according to the invention is distinguished by good creep rupture strength, a stable microstructure and good casting properties.

Moreover, the resistance of the alloy to oxidation is very good. The alloy is eminently suitable for the production of single-crystal components, for example blades or vanes for gas turbines.

On account of the low level of secondary precipitation-hardening γ' phase which is incorporated in the greatly strengthened γ phase, the degradation behavior of the alloy according to the invention is good. There is no single-crystal crack growth and no great drop in the yield strength at room temperature in the degraded state compared to the undegraded state.

Preferred ranges for the nickel-base superalloy according to the invention are (details in % by weight):

10–13 Cr
8–9 Co
1.5–2 Mo
3–5 W
4–5 Ta
3–5 Al
2–4 Ti
0.3–4 Ru
0.01–0.5 Hf
0.001–0.15 Si
0–700 ppm C
0–300 ppm B
remainder nickel and production-related impurities.

A particularly preferred range for the nickel-base superalloy according to the invention is as follows:

10–13 Cr
8–9 Co
1.5–2 Mo
3.5–4 W
4–5 Ta
3.5–5 Al
3–4 Ti
0.3–1.5 Ru
0.5 Hf
10–500 ppm Si
250–350 ppm C
80–100 ppm B
remainder nickel and production-related impurities.

A further nickel-base superalloy according to the invention has the following chemical composition (details in % by weight):

7–9 Cr
8–9 Co
1.5–2 Mo
3–5 W
5–6 Ta
3–5 Al
1–2 Ti
0.5–1.5 Ru
0.5 Hf
700 ppm C
100 ppm B
500 ppm Si
remainder nickel and production-related impurities.

BRIEF DESCRIPTION OF THE DRAWINGS

Two exemplary embodiments of the invention are illustrated in the drawings, in which.

DETAILED DESCRIPTION OF THE INVENTION

The invention is explained in more detail below with reference to exemplary embodiments and FIGS. 1 to 7.

Nickel-base superalloys having the chemical composition given in Table 1 were investigated (details in % by weight):

TABLE 1

Chemical composition of the alloys investigated

| | L1 (AMN1) | L2 (AMN3) | VL (PW 1483) |
|---|---|---|---|
| Ni | Remainder | Remainder | Remainder |
| Cr | 9.96 | 12.34 | 12.8 |
| Co | 8.86 | 8.84 | 9 |
| Mo | 1.47 | 1.85 | 1.9 |
| W | 3.45 | 3.76 | 3.8 |
| Ta | 4 | 4.96 | 4 |
| Al | 3.57 | 3.45 | 3.8 |
| Ti | 3.83 | 3.96 | 4 |
| Hf | 0.5 | 0.48 | — |
| C | 0.025 | 0.033 | — |
| B | 86 ppm | 79 ppm | — |
| Si | 10 ppm | 10 ppm | — |
| Ru | 1.07 | 0.28 | — |

The alloys L1 and L2 are alloys whose composition is covered by the patent claims of the present invention. By contrast, the alloy VL is a comparative alloy which forms part of the known prior art under the designation PW 1483. It differs from the alloys according to the invention primarily in that it is not alloyed with ruthenium and there is no significant Si content. The alloys L2 and VL are virtually identical in composition with regard to the elements Cr, Co, Mo, Ta, Al, Ti and Ni. Apart from the Cr content, this is also true of the alloy L1. In L1, the Cr content is approx. 3% by weight lower than in the comparative alloy VL.

All three alloys were subjected to the following heat treatment: 1 h/1204° C.+1 h/1265° C.+4 h 1080° C.

The Vickers hardness HV2 was measured. This gave the results listed in Table 2.

TABLE 2

Vickers hardness for the alloys investigated

| | L1 | VL |
|---|---|---|
| HV2 | 447 | 403 |

Therefore, the alloy L1 has a hardness which is more than 10% higher than that of the comparative alloy VL. The γ phase (matrix) of the alloys according to the invention is strengthened primarily by the ruthenium which is included in the alloy.

Figure 1:
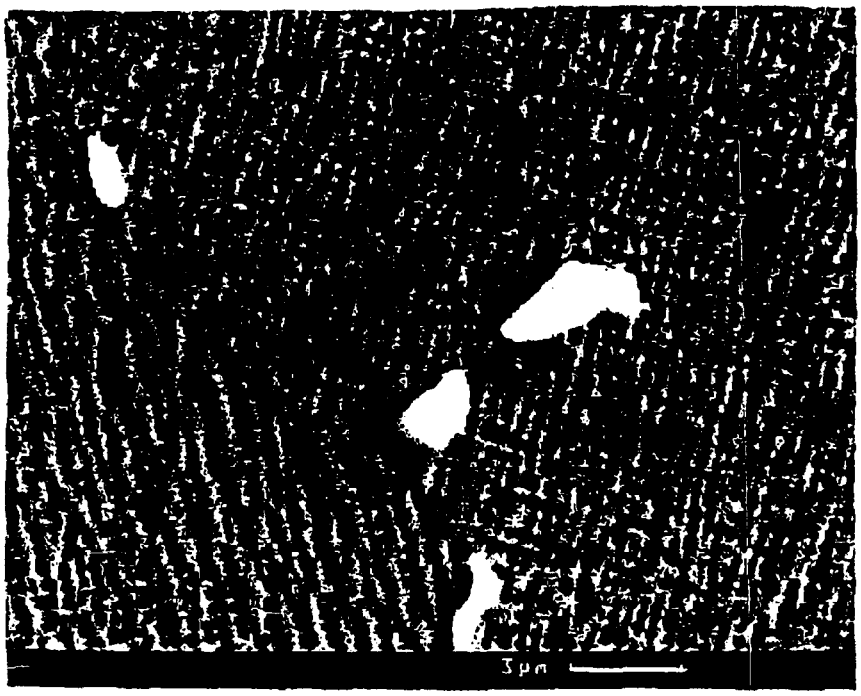
FIG. 1 shows a micrograph illustrating the microstructure of the comparative alloy VL.
Figure 2:
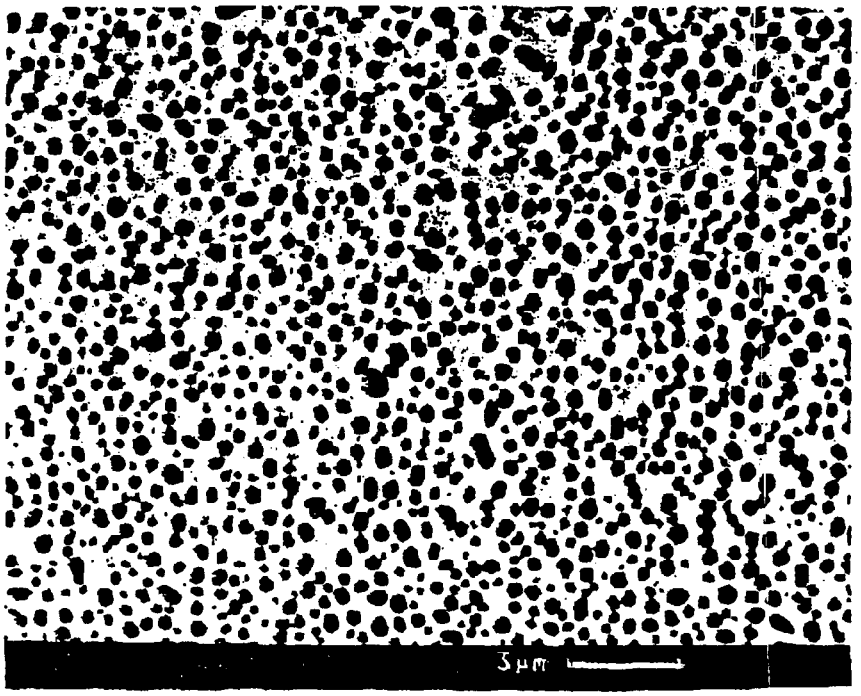
FIG. 2 shows a micrograph illustrating the microstructure of the inventive alloy L1.

FIG. 1 shows the microstructure of the comparative alloy VL1, while FIG. 2 shows the microstructure of the inventive alloy L1.

Compared to the alloy VL, the lower level of γ' phase (dark particles) in the alloy L1 is clearly apparent. The γ' phase (secondary, intermetallic phase formed by precipitation hardening) is approximately quadrilateral in the alloy VL and is arranged in strip form in the matrix. By contrast, in L1 the γ' phase is spherical, which indicates a very low lattice offset between the γ phase and the γ' phase. This low lattice offset, and in particular the low level of γ' phase by volume (less than 50%), has a positive effect to the extent that there is no γ/γ' inversion in the microstructure, i.e. the γ' phase is embedded in the γ phase and does not form a continuous network. This results in a good degradation behavior of the alloys according to the invention.

Figure 3:
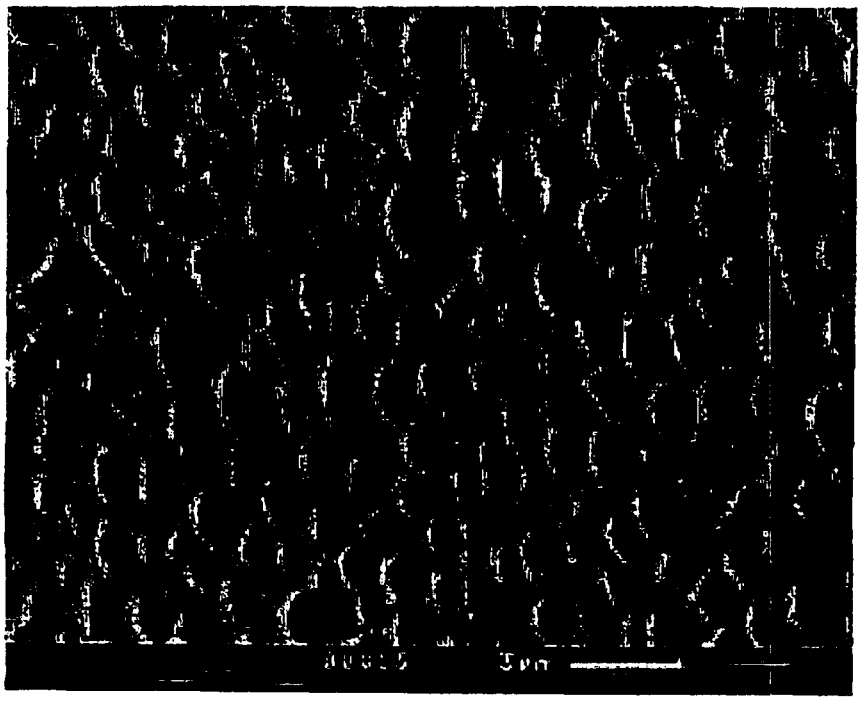
FIG. 3 shows a micrograph illustrating the microstructure of the inventive alloy L1 after degradation.
Figure 4:
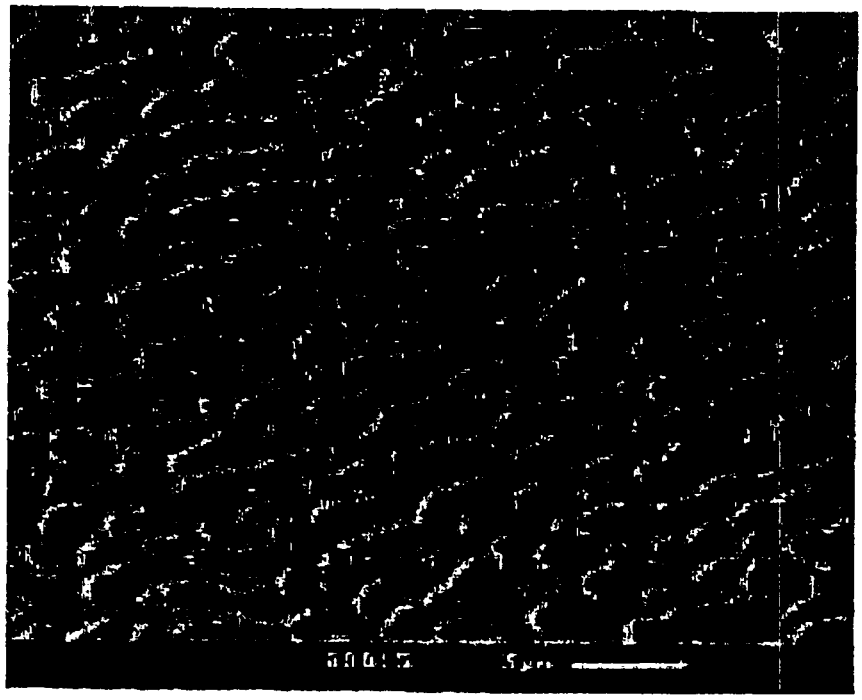
FIG. 4 shows a micrograph illustrating the microstructure of the inventive alloy L2 after degradation.

FIGS. 3 and 4 show micrographs illustrating the microstructure of the inventive alloys L1AD (FIG. 3) and L2AD (FIG. 4) in the degraded state (T=1000° C., σ=80 MPa, t=747 h). The γ' phase is embedded in the γ phase and does not form a continuous network. The alloy L1AD reveals predominantly round to oval shapes of the γ' phase, while in the alloy L2AD the γ' phase is very elongate in form.

Figure 5:
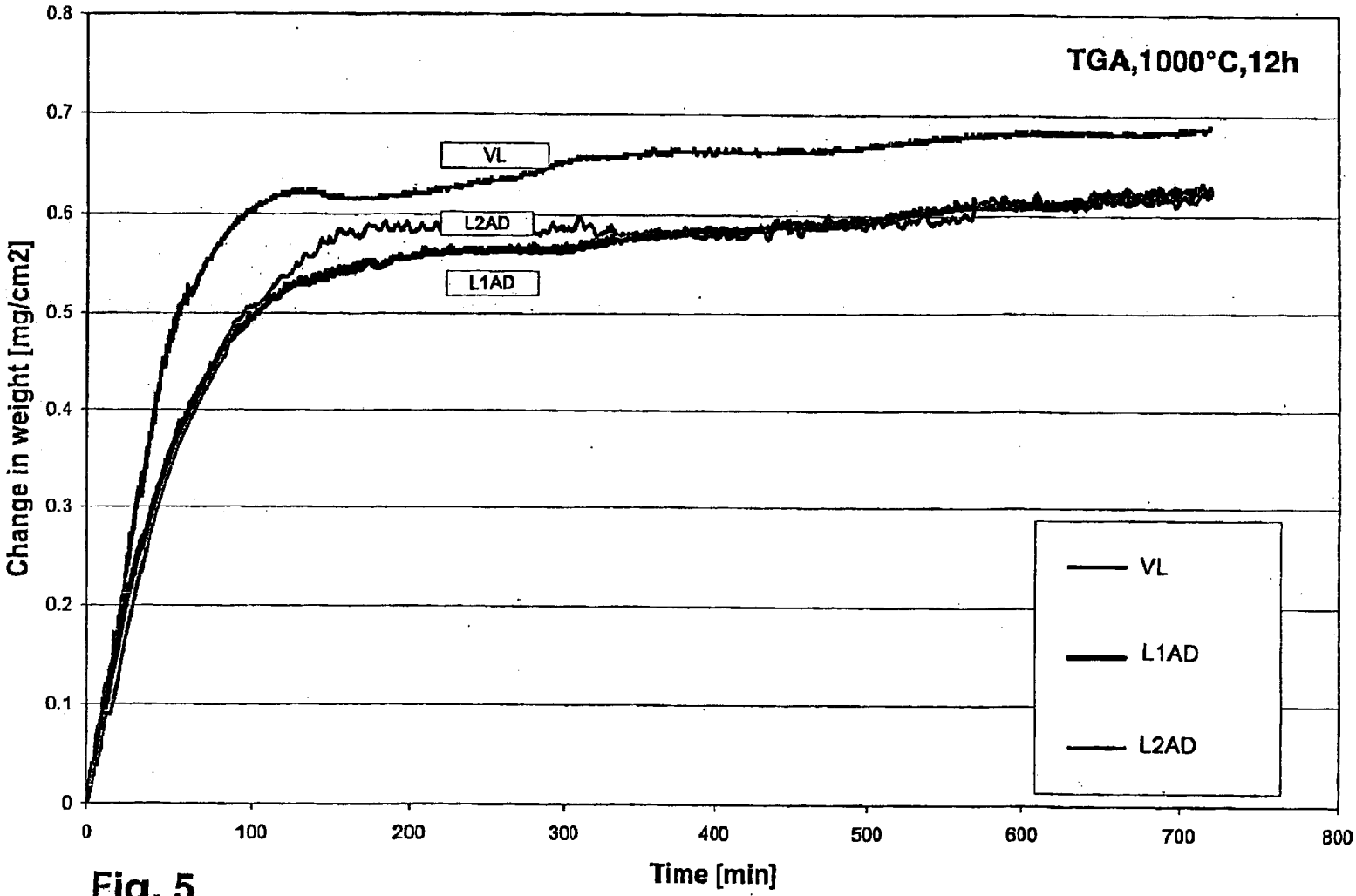
FIG. 5 shows a diagram which shows the change in weight of the alloys VL, L1 and L2 as a function of time.

This has effects on the properties. FIG. 5 shows the change in weight as a function of time for the three alloys. The inventive alloys undergo a significantly lower change in weight after degradation than the comparative alloy which is known from the prior art, i.e. they have a significantly better resistance to oxidation.

Figure 6:
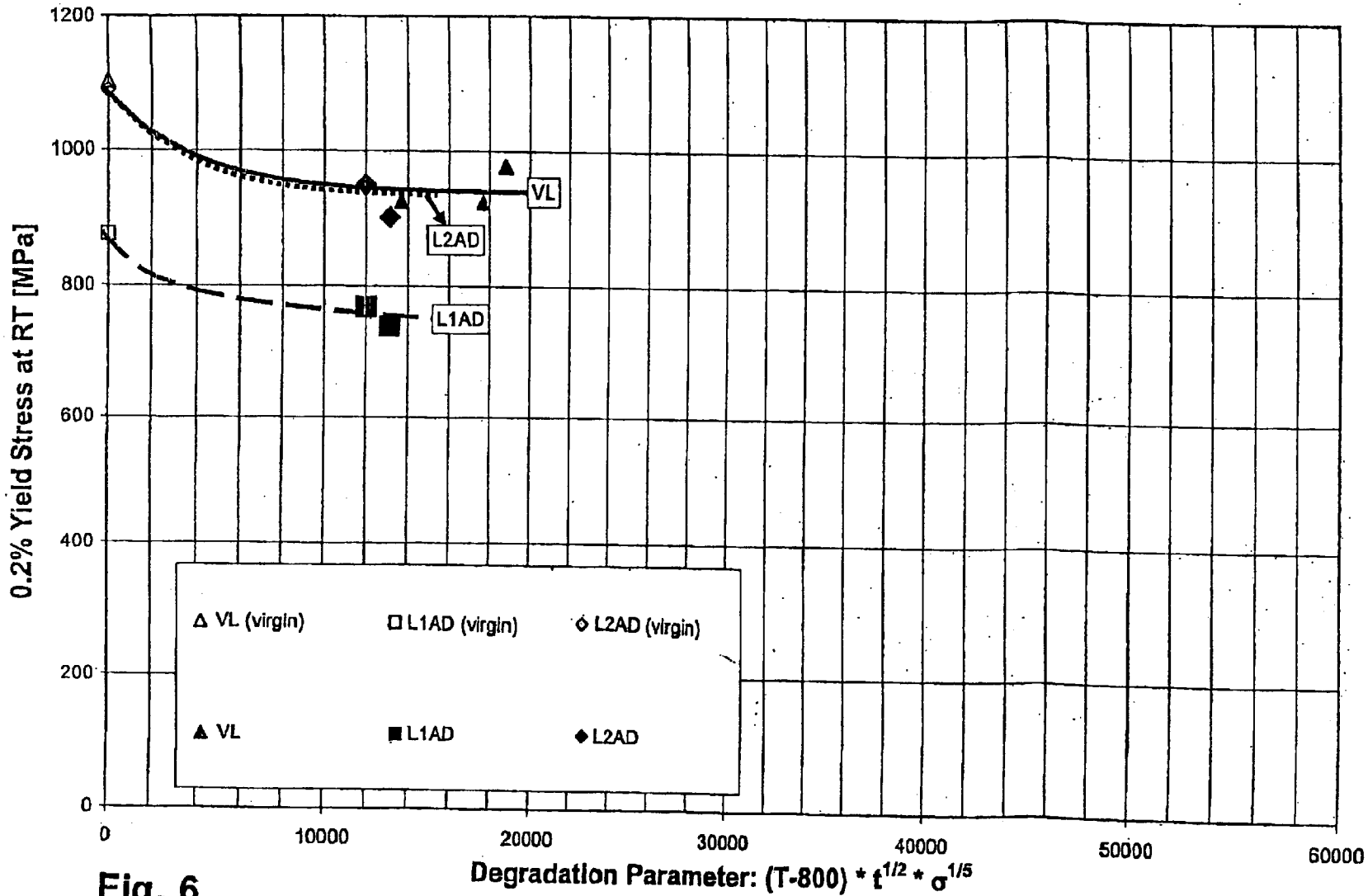
FIG. 6 shows a diagram which shows the 0.2% yield strength of the alloys VL, L1 and L2 as a function of the degradation parameter.

FIG. 6 shows the way in which the 0.2% yield strength at room temperature is dependent on the degradation parameter P, with $$P=(T-800)t^{1/2}\sigma^{1/5}.$$

While the comparative alloy VL and the alloy L2AD behave almost identically, for L1AD the stress is approx. 200 MPa below the values for VL and L2AD.

Figure 7:
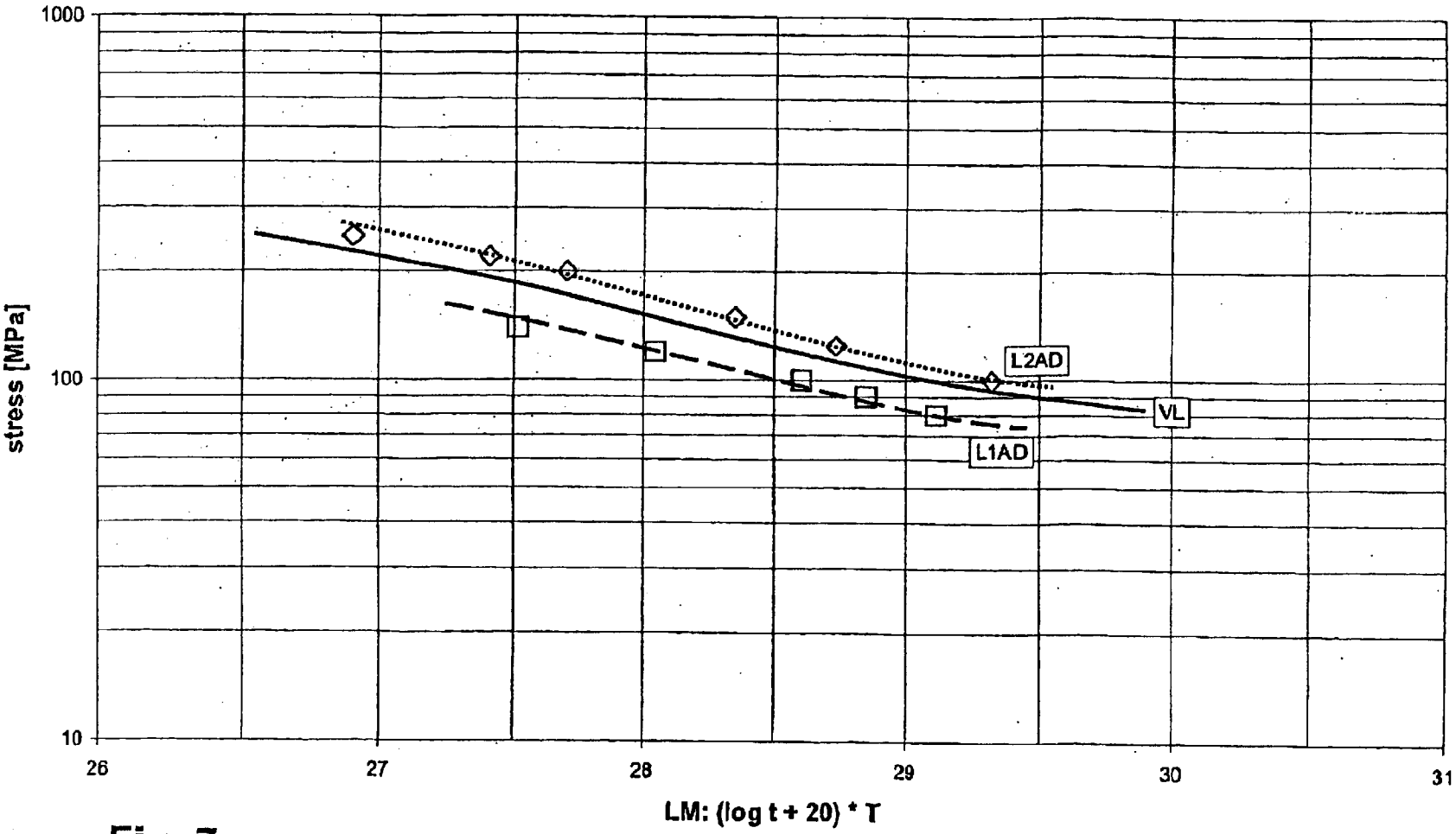
FIG. 7 shows a diagram which indicates the stress (1% elongation limit) of the alloys VL, L1 and L2 as a function of the Larson Miller parameter.

If the 0.1 elongation limit is plotted against the Larson Miller parameter LM, where $$LM=T(\log t+20),$$

the dependent relationships illustrated in FIG. 7 result. The alloy L2AD has higher elongation limits over the entire range than the comparative alloy (with an improved oxidation behavior). Although the alloy L1AD only has lower elongation limits than the comparative alloy VL, to make up for this it likewise has a significantly better resistance to oxidation.

Of course, the invention is not restricted to the exemplary embodiments described.

What is claimed is:

1. A nickel-base superalloy for producing single-crystal components, comprising the following chemical composition (details in % by weight):

7–13 Cr
4–10 Co
0.5–2 Mo
2–8 W
4–6 Ta
3–6 Al
1—4 Ti
0.1–6 Ru
0.01–0.5 Hf
0.001–0.15 Si
0–700 ppm C
0–300 ppm B remainder nickel and production-related impurities.

2. The nickel-base superalloy as claimed in claim 1, comprising the following chemical composition (details in % by weight):

10–13 Cr
8–9 Co
1.5–2 Mo
3–5 W
4–5 Ta
3–5 Al
2–4 Ti
0.3–4 Ru
0.01–0.5 Hf
0.001–0.15 Si
0–700 ppm C
0–300 ppm B remainder nickel and production-related impurities.

3. The nickel-base superalloy as claimed in claim 2, comprising the following chemical composition (details in % by weight):

10–13 Cr
8–9 Co
1.5–2 Mo
3.5–4 W
4–5 Ta
3.5–5 Al
3–4 Ti
0.3–1.5 Ru
0.5 Hf
10–500 ppm Si
250–350 ppm C
80–100 ppm B remainder nickel and production-related impurities.

4. The nickel-base superalloy as claimed in claim 1, comprising the following chemical composition (details in % by weight):

7–9 Cr
8–9 Co
1.5–2 Mo
3–5 W
5–6 Ta
3–5 Al
1–2 Ti
0.5–1.5 Ru
0.5 Hf
500 ppm Si
700 ppm C
100 ppm B remainder nickel and production-related impurities.

* * * * *